United States Patent [19]

Duda

[11] Patent Number: 4,731,909

[45] Date of Patent: Mar. 22, 1988

[54] APPARATUS FOR CONTROLLING THE FEED ROLLER OF A FIBER TUFT FEEDER

[75] Inventor: Günter Duda, Mönchengladbach, Fed. Rep. of Germany

[73] Assignee: Trützschler GmbH & Co. KG, Mönchengladbach, Fed. Rep. of Germany

[21] Appl. No.: 59,219

[22] Filed: Jun. 8, 1987

Related U.S. Application Data

[63] Continuation of Ser. No. 906,082, Sep. 11, 1986, abandoned.

[30] Foreign Application Priority Data

Sep. 11, 1985 [DE] Fed. Rep. of Germany ..... 3532410
Jul. 25, 1986 [DE] Fed. Rep. of Germany ..... 3625311

[51] Int. Cl.[4] ..... D01G 23/02; D01G 15/40

[52] U.S. Cl. ..... 19/105; 19/106 R; 19/240; 19/300

[58] Field of Search ..... 19/105, 106 R, 240, 19/300

[56] References Cited

U.S. PATENT DOCUMENTS 4,161,052 7/1979 Erben ..... 19/240
4,321,732 3/1982 Erben ..... 19/105 X
4,506,413 3/1985 Leifeld ..... 19/105
4,510,647 4/1985 Keller et al. ..... 19/105
4,562,358 12/1985 Hösel ..... 307/118

FOREIGN PATENT DOCUMENTS 2100304 12/1982 United Kingdom .
2121448 12/1983 United Kingdom .

*Primary Examiner*—Louis K. Rimrodt
*Attorney, Agent, or Firm*—Spencer & Frank

[57] ABSTRACT

An apparatus for regulating the rpm of the feed roller of the tuft feeder and having an rpm measuring device connected to at least one card roller for generating a first signal representing an operational magnitude of the card roller; a signal generating device connected to an output of the rpm measuring device and arranged for generating a second signal as a function of the first signal; a pressure sensing device for sensing pressure in the feed chute and for generating a third signal representing the pressure; a regulator connected to an output of the pressure sensing device and arranged for generating a fourth signal as a function of the third signal; and an integrating device connected to an output of the signal generating device and an output of the regulator for receiving the second and fourth signals and emitting a fifth signal as a function of the second and fourth signals. The integrating device is connected to the output amplifier for applying the fifth signal thereto. The output amplifier is connected to the rpm-variable drive motor of the feed roller for the tuft feeder.

7 Claims, 3 Drawing Figures

APPARATUS FOR CONTROLLING THE FEED ROLLER OF A FIBER TUFT FEEDER

This application is a continuation, of application Ser. No. 06/906,082, filed Sept. 11th, 1986, now abandoned.

BACKGROUND OF THE INVENTION

This invention relates to an apparatus for regulating or controlling the feed roller of a fiber tuft feeder in which the feed roller is driven by an rpm-variable motor.

In a known apparatus of the above type, in the operational zone between a reserve chute (upper chute) of a tuft feeder which supplies a card or a roller card unit with a fiber lap and an after-connected card or roller card unit there are provided the following rollers involved in advancing the fiber material: the feed roller of the tuft feeder which serves for advancing a tuft column from the reserve shaft past an opening roller into the feed chute (lower chute), the feed roller of the card or roller card unit which advances the fiber lap in the direction of the licker-in and the doffer of the card for removing the fiber material from the main carding cylinder. These rollers are all driven by rpm-variable drive motors.

In the above-outlined known apparatus, upon changing production parameters, particularly upon varying the intake speed of the card, a new setting, based upon observation, has to be effected for the feed roller of the tuft feeder. For this reason, frequently the setting will not be optimal. Upon changes of the output speed during the processing of one batch, effected usually upon observation, coiler can replacements, production adaptation for the entire cleaning line or the like, there occur, during slow run, stop-and-go conditions which result in a reduced quality of the fiber material to be processed.

SUMMARY OF THE INVENTION

It is an object of the invention to provide an apparatus of the above-outlined type with which the noted disadvantages are eliminated and which permits, in particular, an adaptation (coordination) of the tuft feeder to the after-connected carding machine.

This object and others to become apparent as the specification progresses, are accomplished by the invention, according to which, briefly stated, there is provided an apparatus which regulates the rpm of the feed roller of the tuft feeder and which has an rpm measuring device connected to at least one card roller for generating a first signal representing an operational magnitude of the card roller; a signal generating device connected to an output of the rpm measuring device and arranged for generating a second signal as a function of the first signal; a pressure sensing device for sensing pressure in the feed chute and for generating a third signal representing the pressure; a regulator connected to an output of the pressure sensing device and arranged for generating a fourth signal as a function of the third signal; and an integrating device connected to an output of the signal generating device and an output of the regulator for receiving the second and fourth signals and emitting a fifth signal as a function of the second and fourth signals. The integrating device is connected to the output amplifier for applying the fifth signal thereto. The ouput amplifier is connected to the rpm-variable drive motor of the feed roller for the tuft feeder.

According to the invention, a control of the fiber material flow between the reserve chute (upper chute) and the after-connected carding machine is achieved. The basic desired value for the rpm of the drive for the feed roller of the tuft feeder is derived from the actual rpm of the feed roller of the carding machine.

Thus, according to the invention, there is effected an interrelated drive of two machines, that is, the tuft feeder and the after-connected carding machine, as well as the associated machine control and regulating devices. By means of such a coupling an analog drive down to very low operational speeds is feasible. In this manner, a better quality of the processed fiber material is achieved.

The operating conditions of the system may be preserved in memories of the card control so that in case of repeat productions the programs may be called in a simple manner. Thus, the tuft feeder may be coupled, data-wise too, in a simple and economical manner with the carding machine because the carding data may be used by the tuft feeder as well. By virtue of the advantageous coupling of the tuft feeder and the after-connected carding machine, an adaptation (coordination) between these machines is achieved.

According to a further feature of the invention, the rpm-measuring device is a tachogenerator or a pulse generator. The tachogenerator or pulse generator may be arranged on the feed roller of the tuft feeder and/or the doffer of the card. There is provided a follow-up control which affects the drive motor of the feed roller of the tuft feeder with the aid of the electric signal obtained from the tachogenerator or pulse generator. Expediently, a transducer is connected with the tachogenerator or pulse generator, and an rpm-equalizing element is advantageously associated with the transducer. The rpm-equalization is required during the initial set-up of the apparatus.

The invention thus provides to an apparatus for controlling or regulating the feed roller of a tuft feeder wherein the rpm-variable motor is connected with a regulator and wherein the rpm may be set as a function of an after-connected (downstream appearing) measuring magnitude, for example, the pressure prevailing in the feed chute of the tuft feeder and wherein the output amplifier (for example, the motor regulator) of the drive motor is connected with the rpm measuring device arranged on the feed roller and/or the doffer of the card. In this arrangement, the follow-up control affects a regulating circuit, for example, with an electric signal obtained from the tachogenerator or pulse generator.

In the regulating circuit for the tuft feeding installation where the feed roller for the tuft feeder is regulated in an analog manner as a function of, for example, the pressure prevailing in the feed chute, the drive switches over to the stop-and-go operation upon a deviation of the rpm of more than 25–30%. In the coupled state the feed roller drive leads steplessly into the smallest rpm range and the homogenous material flow is not interrupted, whereby the quality of the fiber material is improved also during the start-up. In this manner the setting magnitude from the regulating circuit is superposed on the basic desired value for the rpm of the drive for the feed roller of the tuft feeder.

DESCRIPTION OF THE PREFERRED EMBODIMENTS

Figure 1:
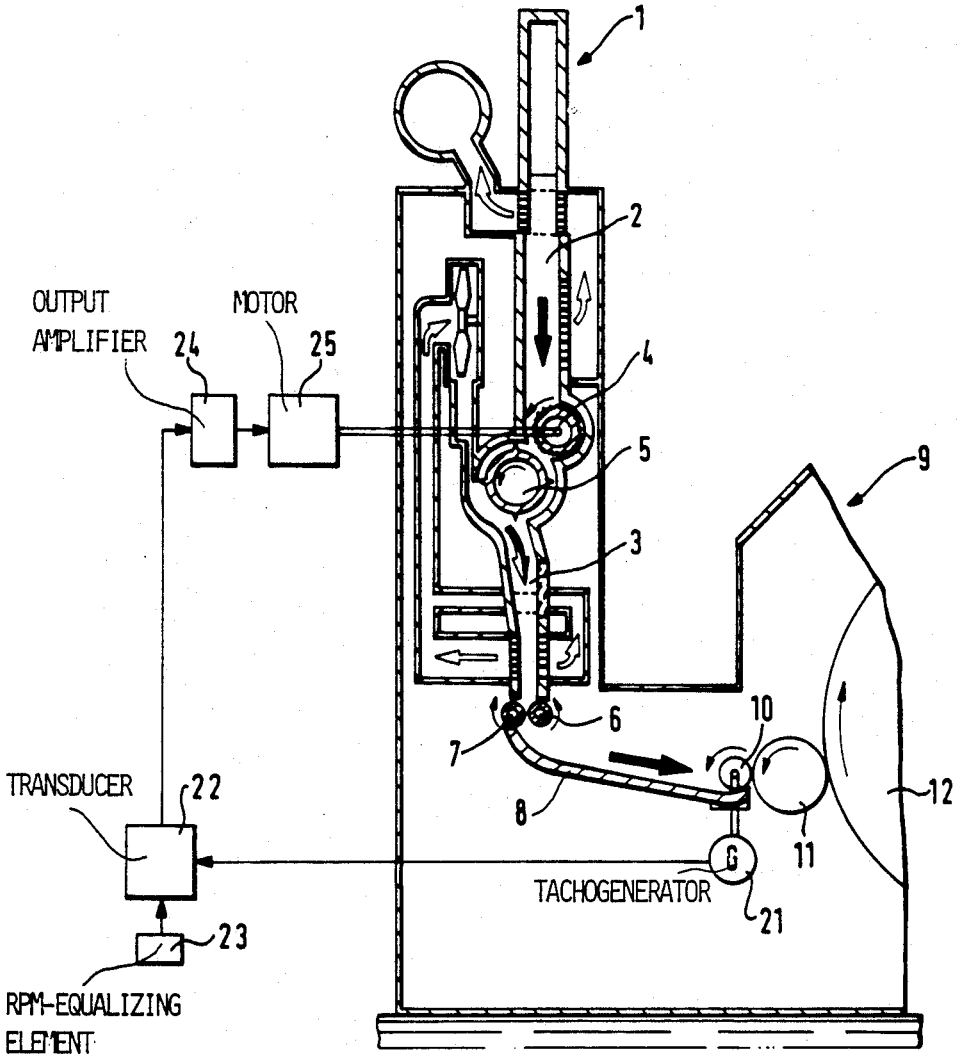
FIG. 1 is a schematic sectional side elevational view, with block diagram, of an rpm controlled text feeder.
Figure 2:
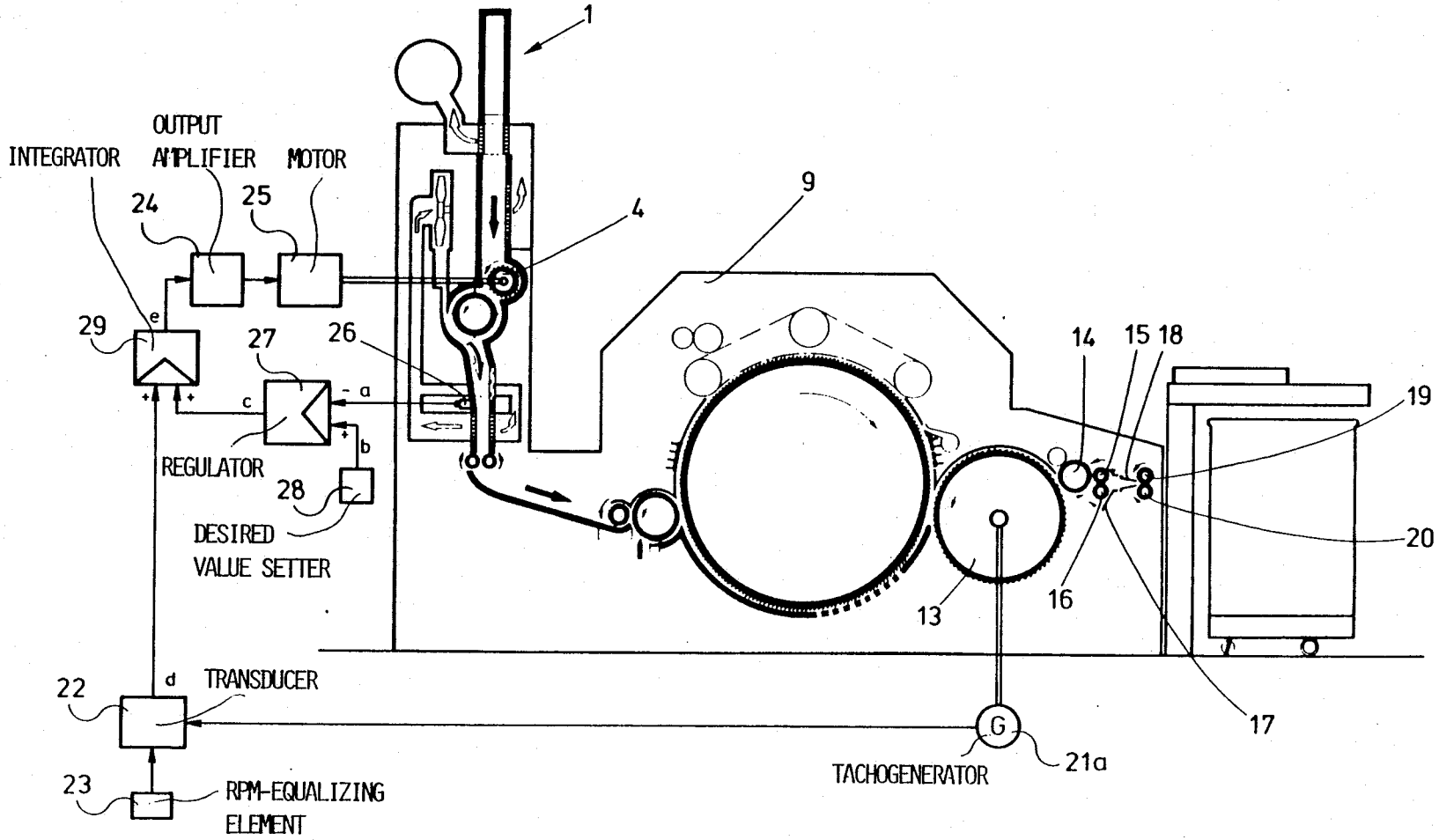
FIG. 2 is a schematic sectional side elevational view, with block diagram, of a preferred embodiment of the invention.

Turning to FIG. 1, there is shown a known tuft feeder 1 which may be an EXACTAFEED FBK Model to which there is connected a carding machine 9 which may be an EXACTACARD DK3 Model, both machines being of known construction, manufactured by Trützschler GmbH & Co., Mönchengladbach, Federal Republic of Germany. The tuft feeder 1 has a reserve chute (upper chute) 2 and a feed chute (lower chute) 3. The fiber material is introduced by a feed roller 4 and an opening roller 5 from the reserve chute 2 into the feed chute 3. At the lower end of the feed chute 3 cooperating discharge rollers 6 and 7 are arranged which pull the fiber material from the feed chute 3 and advance the fiber material, in the form of a fiber lap, on a feed tray 8. From the feed tray 8 the fiber lap is fed to the carding machine 9 which has a feed roller 10, followed by a licker-in 11, a carding cylinder 12 and—as shown in FIG. 2- a doffer 13, a stripping roller 14, crushing rollers 15 and 16, a web guide element 17, a sliver trumpet 18 and calender rollers. The doffer 13 has a circumferential speed between 60 and 22 m/min.

The feed roller 10 of the carding machine 9 is coupled with a tachogenerator 21 which constitutes a measuring device for determining the rpm of the feed roller 10. A transducer 22 with an rpm equalizing element 23 is electrically connected to the output of the tachogenerator 21. The rpm equalization is required only during installation (initial set-up) of the machines. The transducer 22 is connected with an output amplifier 24, for example, the motor regulator of the rpm-variable drive motor 25 for the feed roller 4 of the tuft feeder 1. In this manner, a follow-up control is effected which, with an electric signal—representing the rpm of the feed roller 10 —emitted by the tachogenerator 21 affects the drive motor 25 of the feed roller of the tuft feeder 1.

Turning now to the embodiment illustrated in FIG. 2, a tachogenerator 21*a* is associated with the doffer 13 of the carding machine 9. The tachogenerator 21*a* is, similarly to the FIG. 1 arrangement, connected by means of a transducer 22 and an output amplifier 24 with the drive motor 25 and thus with the feed roller 4 of the tuft feeder 1. On the feed chute 3 there is arranged a pressure switch 26 whose output is connected with a regulator 27 and applies a signal a (−) corresponding to the actual pressure value. A desired value setter 28 is connected with the regulator 27 for applying a signal b (+) thereto corresponding to the desired pressure value. The regulator 27 is connected with the drive motor 25 through the intermediary of a summing (integrating) device 29 for the desired rpm values and an output amplifier 24, such as a motor regulator. The regulator 27 applies an rpm correction value c (+) to the summing device 29, whereby a regulator circuit is provided. The rpm of the feed roller 4 is set or, as the case may be, corrected as a function of the pressure in the feed chute 3. The tachogenerator 21*a* which is associated with the doffer 13 of the carding machine 9 is also connected with the summing device 29 through the intermediary of a transducer 22. The transducer 22 applies a basic desired rpm value d (+) to the summing device 29. The summing device 29 applies a setting magnitude e to the output amplifer 24. In this manner the setting magnitude c from the regulating circuit is superimposed on the basic desired value d for the rpm of the drive motor 25 serving the feed roller 4.

Figure 3:
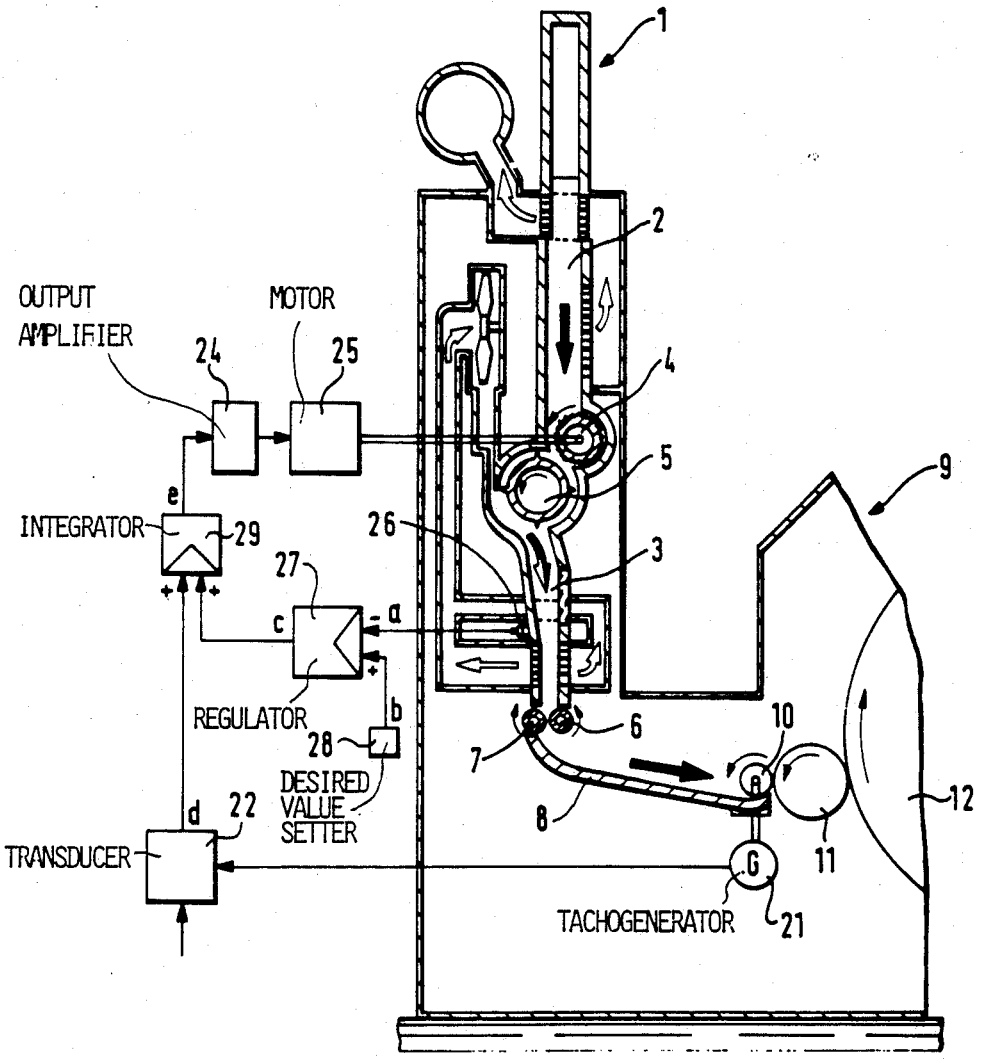
FIG. 3 is a schematic sectional side elevational view of a further preferred embodiment of the invention.

Turning to the embodiment shown in FIG. 3, on the feed chute 3 there is mounted an electronic pressure sensor switch 26 whose output is connected with a regulator 27 and which emits a signal a (−) which represents the actual pressure value. With the regulator 27 there is associated a desired value setter 28 which applies a signal b (+) representing the desired pressure value. The regulator 27 is, by means of an integrating device 29 for the rpm desired values and by means of an output amplifier 24 (for example, a motor regulator) connected with a drive motor 25 of the feed roller 4 of the tuft feeder 1. The regulator 27 applies an rpm correctional value c (+) to the integrating device 29, whereby a regulating circuit is formed. The rpm of the feed roller 4 is corrected as a function of the pressure in the feed chute 3. The tachogenerator 21 which is associated with the feed roller 10 of the carding machine 9, is also connected with the integrating device 29 by the transducer 22. The transducer 22 transmits a basic rpm desired value d (+) to the integrating device 29. The latter in turn applies a setting magnitude e to the output amplifier 24. In this manner, the setting magnitude c obtained from the regulating circuit is superposed on the basic desired value d for the rpm of the drive motor 25 of the feed roller 4 of the tuft feeder 1. Thus, the control circuit of FIGS. 2 and 3 differ from one another essentially only in that in the FIG. 2 embodiment the rpm of the card feed roller 10 is utilized.

It will be understood that the above description of the present invention is susceptible to various modifications, changes and adaptations, and the same are intended to be comprehended within the meaning and range of equivalents of the appended claims.

What is claimed is:

1. In a system including a fiber tuft feeder and a carding machine operatively coupled to the fiber tuft feeder or receiving a fiber lap therefrom; the tuft feeder having a feed chute and a first feed roller advancing fiber tufts into the feed chute, and the carding machine having a second feed roller arranged for advancing the fiber lap and a doffer situated downstream of said second feed roller; said second feed roller and said doffer constituting card rollers; an rpm-variable motor drivingly connected to said first feed roller and an output amplifier forming part of said rpm-variable motor; and control means for controlling the operation of said first feed roller; the improvement in said control means comprising (a) an rpm measuring means connected to at least one of said card rollers for generating a first signal representing an operational magnitude of said at least one card roller;

(b) signal generating means connected to an output of said rpm measuring means and arranged for generating a second signal as a function of said first signal;

(c) pressure sensing means for sensing pressure in said feed chute and for generating a third signal representing said pressure;

(d) a regulator connected to an output of said pressure sensing means and arranged for generating a fourth signal as a function of said third signal; and (e) an integrating device connected to an output of said signal generating means and an output of said regulator for receiving said second and fourth signals and being arranged for emitting a fifth signal as a function of said second and fourth signals; said integrating device being connected to said output amplifier for applying said fifth signal thereto.

2. A system as defined in claim 1, wherein said rpm measuring means comprises a tachogenerator.

3. A system as defined in claim 1, wherein said rpm measuring means comprises a pulse generator.

4. A system as defined in claim 1, wherein said signal generating means comprises a transducer.

5. A system as defined in claim 4, further comprising an rpm equalizing element having an output connected to an input of said transducer.

6. A system as defined in claim 1, wherein said rpm measuring means is connected to said doffer.

7. A system as defined in claim 1, wherein said rpm measuring means is connected to said second feed roller.

* * * * *